US005622641A

United States Patent [19]

Kim et al.

[11] Patent Number: 5,622,641

[45] Date of Patent: Apr. 22, 1997

[54] METHOD FOR IN-SITU REDUCTION OF PCB-LIKE CONTAMINANTS FROM CONCRETE

[75] Inventors: Bang M. Kim; Andrew P. Shapiro, both of Schenectady, N.Y.; Henry S. Spacil, St. Croix, Virgin Islands (U.S.)

[73] Assignee: General ElectricCompany, Schenectady, N.Y.

[21] Appl. No.: 270,541

[22] Filed: Jul. 5, 1994

[51] Int. Cl.[6] ..... H05B 3/08; H05B 1/00; G21F 9/00

[52] U.S. Cl. ..... 219/541; 588/10; 219/213; 219/535

[58] Field of Search ..... 219/528, 548, 219/549, 213, 200, 552, 553; 588/10, 16, 12; 405/130, 131, 128; 404/75, 77

[56] References Cited

U.S. PATENT DOCUMENTS

| | | | |
|---|---|---|---|
| 4,984,594 | 1/1991 | Vinegar et al. . | |
| 5,193,934 | 3/1993 | Johnson et al. | 405/128 |
| 5,209,604 | 5/1993 | Chou | 405/128 |
| 5,221,827 | 6/1993 | Marsden, Jr. et al. | 219/528 |
| 5,229,583 | 7/1993 | Van Egmond et al. | 219/528 |
| 5,233,164 | 8/1993 | Dicks et al. | 219/528 |
| 5,283,010 | 2/1994 | Waring | 252/626 |
| 5,425,072 | 6/1995 | Li et al. | 376/310 |

*Primary Examiner*—Teresa J. Walberg
*Assistant Examiner*—Sam Paik
*Attorney, Agent, or Firm*—James Magee, Jr.

[57] ABSTRACT

A method for decontaminating of concrete and more specifically to methods used for in-situ thermal desorption of contaminants from concrete, such as PCBs is disclosed. The methods employed heat the concrete at reduced pressure and at a temperature sufficient to volatilize and draw off the contaminant vapors so that the concrete is decontaminated to greater depth than previously obtained, that no concrete waste is created which requires disposal, that the methods produce no secondary liquid waste, that no chemical agents are required, that the decontaminated concrete material can be reused, that the methods are safer for workers because there is no contaminated dust formed during the process and specifically that the process produce a low energy cost per unit area decontamination for the concrete.

18 Claims, 8 Drawing Sheets

METHOD FOR IN-SITU REDUCTION OF PCB-LIKE CONTAMINANTS FROM CONCRETE

RELATED APPLICATION

This application is related to commonly assigned U.S. patent application Ser. No. 08/270,543 (RD-22,853) of Shapiro et al., filed Jul. 5, 1994, and incorporated by reference herein.

BACKGROUND OF THE INVENTION

The present invention relates to methods for decontaminating concrete and, more specifically, to methods used for in-situ thermal desorption of contaminants from concrete.

Because many concrete building surfaces have been contaminated with PCBs since their industrial use became prominent in the 1940's as a dielectric insulating oil and heat transfer fluid, it has been desirable to provide an apparatus and a method for decontaminating concrete which contains volatile or semi-volatile materials, such as PCBs. Present technology is not available to thermally desorb contaminants from concrete in a nondestructive manner; however, technology has been described which can thermally desorb contaminants from soil at reduced pressure.

The degree of contamination of concrete is usually determined as a surface concentration. The standard method for quantifying the contamination is by wipe tests in which solvent-soaked pads are wiped across a given area of the surface and thereby soak up PCBs that dissolve in the solvent. The PCBs are then extracted from the pad to determined a contamination level in mass per unit area. These wipe tests are also used to determine the residual PCBs left after a remedial treatment. Present regulations usually require cleanup levels of less than 10 μg/100 $cm^2$. However such wipe tests cannot ensure that PCBs in the subsurface region will not diffuse or permeate back to the surface with time. In addition, if a concrete structure is going to be destroyed and deposited in a landfill, the material will be subject to regulations which are based on bulk concentrations or mass of PCBs per unit mass of material. For these reasons it is desirable to develop a cost effective technique for removing PCBs from the subsurface as well as the surface of concrete.

The current technologies available for remediation of concrete contaminated with semi-volatile organics such as PCBs can be divided into two categories: surface removal methods and chemical methods. In surface removal methods the exposed layer of contaminated concrete is removed by any of several technologies. These include scarifying, scabbling, spalling induced by mechanical or thermal stresses, sand blasting, liquid jet, frozen carbon dioxide blasting, and controlled explosion. The advantage of surface removal methods is that if the contamination is confined to the surface layer, the technique is certain to remove the contamination regardless of contaminant type. The obvious drawbacks of such methods are that a large volume of contaminated waste is generated which must be processed further or stored in a regulated hazardous waste site and the new concrete surface must be refinished for future use. Typical costs for surface removal techniques range from \$50 to \$250/$m^2$. The volume of concrete rubble produced from such methods is about 10 L/$m^2$.

Chemical methods involve applying a liquid, foam or paste containing chemicals which either destroy the contaminants within the concrete or remove them via dissolution and mobilization. The disadvantages of these methods are that large volumes of liquid hazardous waste are generated, the dissolved contaminants may migrate deeper into the concrete, and it is difficult to control the depth to which the decontamination occurs. In some cases the concrete surface is degraded. The costs for wet methods of cleaning range from \$30 to \$200/$m^2$.

Both in-situ volatilization of organics from soil and ex-situ volatilization from soil and sludge are widely used for remediation, especially where contamination consists of VOCs (Volatile Organic Compounds) or CVOCs (Chlorinated Volatile Organic Compounds). As a guide to appropriate volatilization methods, the following rules of thumb based on contaminant vapor pressure at ambient temperatures may be useful:

| Vapor Pressure at Ambient Temperature, mb | Volatilization Methods |
|---|---|
| 5 | Natural Convection |
| 1 | Forced Convection |
| 0.1 | Heating to 120–250° C. |
| 0.01 | Heating to 250–550° C. |

In-situ soil decontamination processes generally employ forced convection at ambient or relatively low temperatures. The convection can be generated by either pressurization, suction or a combination and elevated temperatures are achieved by pre-heating pressurized air or injecting steam into the soil. A process developed by Drexel University is unique among similar processes in utilizing an impermeable mat over the soil to capture contaminants. Ex-situ processes carried out in batch or continuous equipment are capable of reaching higher temperatures and lower pressures than in-situ processes; these conditions can either improve VOC/CVOC recovery efficiency or allow faster removal rates of less volatile contaminants. While ex-situ processes normally address soil or sludge contamination, volatilization from construction debris such as concrete is clearly possible.

Many continuous ex-situ remediation processes resemble rotary kilns which not only operate at temperatures sufficient to volatilize organic contaminants but also attain conditions which oxidize contaminant vapors to harmless products. Temperatures required for oxidation are typically in the range of 875° to 1375° C. Such temperature would destroy PCB vapors, but destruction by oxidation would require that the process be permitted for incineration. Thus, any thermal desorption process for concrete should operate without exceeding an equipment temperature of about 450° C. at any point, thereby avoiding PCB oxidation and the required permitting.

Two specific volatilization processes for decontaminating concrete (or other noncombustible solids) and soil, respectively, are related to the present application. The first is flaming, in which an open flame is directed against building surfaces such as walls. As with the present invention, flaming is suited to subsurface decontamination of porous materials by volatilization. Achieving a temperature of 300° C. at a depth of 5 cm requires 16 minutes for concrete and 25 minutes for brick has been reported. The process was applied at the Frankford Arsenal to structures contaminated with explosives. In that instance the decomposition and oxidation of volatilized contaminants by the open flame was considered to be an advantage. But applying a similar decontamination process to structures contaminated with PCBs is unlikely from both safety and regulatory standpoints. In particular, the off-gases would be very difficult to control.

The second related process, developed by the Shell Oil Company, is similar to the Drexel process in using an impermeable mat or sheet to collect contaminants volatilized at reduced pressure from heated soil. But the soil is heated from the surface by a flat electrical resistance heater which is located under the sheet and which can reach temperatures as high as 1000° C. As the subsurface soil is heated, organic contaminants are vaporized as in the process we have proposed for concrete. But the permeability of sandy or silty soils is from 3 to 6 orders of magnitude greater than that of concrete, and they contain several times more free or loosely bound water than concrete. As a result the "vacuum" collection system drawing contaminants from the underside of the sheet actually collects large amounts of air drawn through the surrounding soil and water vapor volatilized from the heated soil. This air constitutes a steady state forced convective flow under the applied pressure difference, as opposed to the transient convective flow of background vapor in volatilization from concrete at reduced pressure. Both air flow and water vaporization during soil heating can require a substantial energy input as compared to heating concrete. The high surface temperature of the Shell process is necessary to achieve heat fluxes that will raise subsurface soil to the desired temperatures in reasonable times; however, in concrete where contamination is usually within 1–2 inches of the surface, such high temperatures are not essential.

Thermal desorption of contaminants from solid materials is a process that can be applied to volatile or semi-volatile contaminants. By heating the contaminated material at reduced pressures the volatile and semi-volatile species are vaporized and drawn out of the solid matrix.

Thermal desorption has been used extensively to clean excavated soils. The idea has been applied by Shell Oil Company to removing pesticides from soils in-situ by applying the previously mentioned heating blanket on the surface of the soils and drawing a partial vacuum underneath the blanket. In the Shell process, the soil surface was heated as high as 1000° C. and the pesticides were destroyed by high temperature oxidation.

While there are many similarities between the in-situ soil remediation and the apparatus and method of the present invention for concrete decontamination, there are some key differences. For example, the much lower hydraulic permeability of concrete decreases the significance of air and vapor flow to purge the contaminants from the solid matrix. In concrete, the transport of contaminants out of the matrix will be much more dependent on diffusion and vaporization of hydrated water. Because of the lower air flow rates a greater vacuum pressure should be achievable over concrete thereby reducing the temperature required to volatilize the contaminants.

In the case of PCB decontamination inside a building, it may be desirable to minimize the temperature of the heating elements to prevent the formation of toxic oxidation products such as chlorinated dibenzofurans. Also, to preserve the structural integrity of concrete, the temperatures to which the concrete surface is heated should be kept as low as possible while still removing the contaminants.

In U.S. Pat. No. 4,670,634, Vinegar et al. (Shell patent) propose a method for in-situ decontamination of soil designed to thermally desorb contaminants from soils at reduced pressure. In their embodiment, an impermeable sheet covers permeable insulating material which in turn covers electrical resistance heating elements. These heating elements are in direct thermal contact with the contaminated soil.

One of the problems with the Shell Patent, when applied to PCBs, is that the heater elements will be significantly hotter than the surface of the substrate (soil as described in the patent) which is being heated. These hot heater surfaces may cause the destruction of any PCB vapors which come in contact with them. Such destruction may be undesirable if regulatory agencies require PCB incinerator permitting. Another problem with direct contact of the heating elements with the substrate is that there will be hot spots or regions of steep temperature gradients (uneven heating) in the vicinity of contact points between the heater and the substrate. This is a disadvantage when using the Shell apparatus and method on concrete, because the resulting thermal stresses may weaken or crack the concrete. In addition, the placement of an impermeable layer over a permeable insulator will cause the insulation to become contaminated. This may present difficulties when moving the equipment to another site.

What is desired, therefore, is an apparatus and method for effectively removing volatile or semi-volatile, such as PCBs contamination from concrete which avoids the destruction of large quantities of concrete which avoids the need to deposit destroyed cement in a hazardous landfill; which can be utilized at depths greater than prior chemical methods; which can remove contaminants to an acceptable level while minimizing the hazardous waste generated; which can reduce the level of contamination down to low levels; and which is simple and inexpensive to operate and decontaminate.

SUMMARY OF THE INVENTION

In the present invention, in-situ methods for remediation and decontamination of concrete are disclosed. The methods employed include heating the concrete at reduced pressure and at a temperature to volatilize and draw off the contaminant vapors, for example PCBs.

Accordingly, an objective of this invention is to provide methods for effectively cleaning PCBs from the concrete surface and below.

Another object of the present invention is to provide methods for effectively decontaminate the concrete to greater depth thereby substantially eliminating the possibility of recontamination of the concrete surface from below.

Another object of the present invention is to provide methods for effectively eliminating or at least reducing solvents required or large amounts of solid or liquid wastes produced compared to existing processes.

The main advantages of in-situ thermal decontamination of concrete according to the present invention are: decontamination to greater depth; no concrete waste for disposal; no secondary liquid waste; minimum primary waste for disposal; low energy cost per unit area; no chemical agents required; reuse of concrete material; safer for workers because there is no contaminated dust formed during the process; process can be customized for particular contaminants; and provide for control of off-gases generated during process.

Other objects and advantages of the invention will be apparent from the following description, the accompanying drawings and the appended claims.

DETAILED DESCRIPTION OF PREFERRED EMBODIMENTS

Introduction

The invention disclosed in this application includes methods of utilizing a combined thermal/vacuum system for decontaminating concrete by volatilizing organics and capturing the vapors in, preferably, a condenser followed by a carbon trap. Wipe and core samples before and after cleaning are used to establish the level of cleaning. Preliminary results indicate that the thermal/vacuum system is economically competitive with solvent washing and scarification techniques which cost about \$3–\$20/ft$^2$.

Description of Equipment

Figure 1:
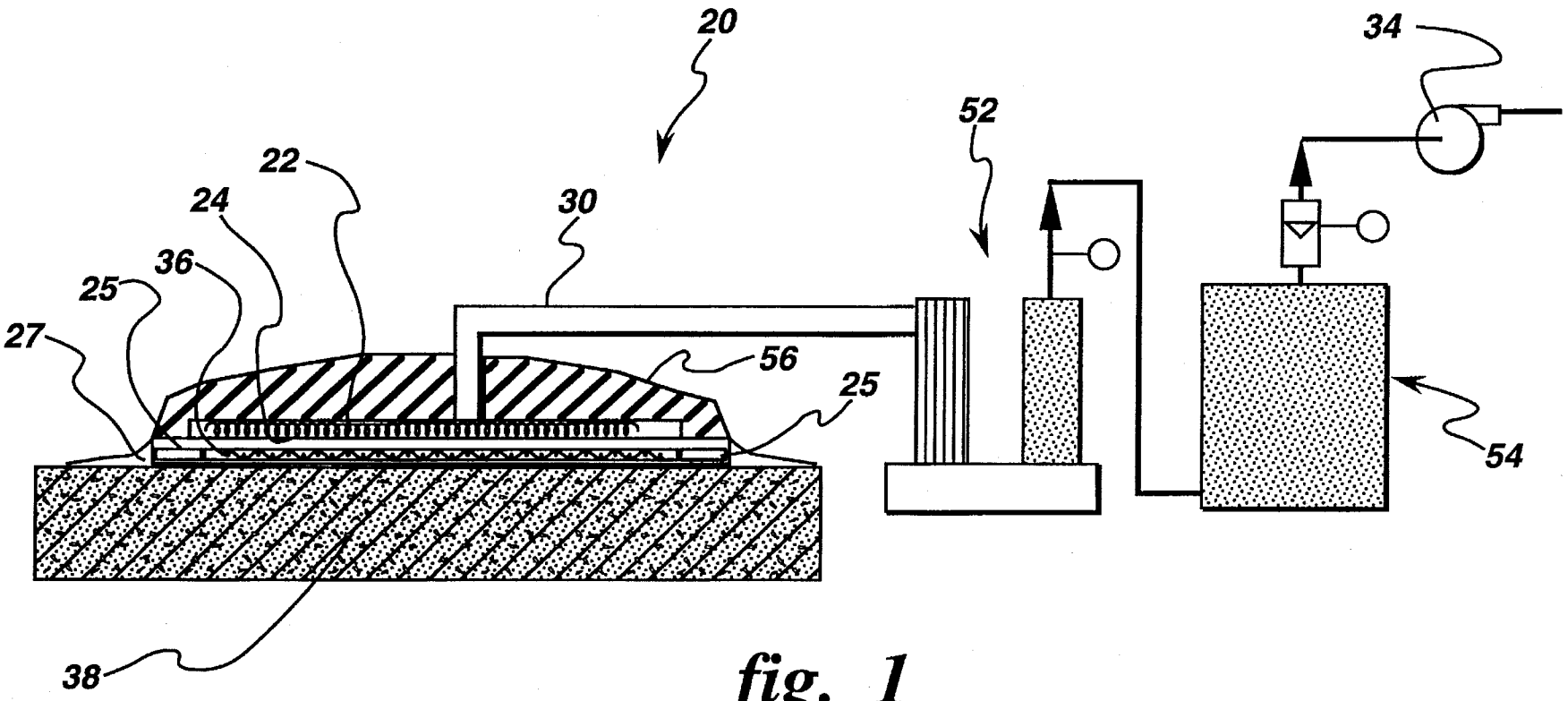
FIG. 1 is a schematic of the thermal/vacuum system for concrete decontamination of the present invention.

A schematic of a prototype thermal/vacuum system 20 representative of one apparatus utilized in the present invention is shown in FIG. 1. Electrical resistance heaters 22, consisting of six 1000 W strip heaters 23 (FIG. 2*b*), are mounted on the top side of a 2 ft×2 ft copper heating plate 24. Spacers 25 around the perimeter of the plate 24 provide a ⅛" air plenum over the heated area 28 (see FIG. 2*a*). Piping 30 leading to a vacuum pump 34 is connected to the air plenum 26 at the center of the plate 24 . Metal, for example, brass, screening 36 fills the air plenum 26 to enhance heat transfer between the plate 24 and the concrete surface 38.

Figure 2A:
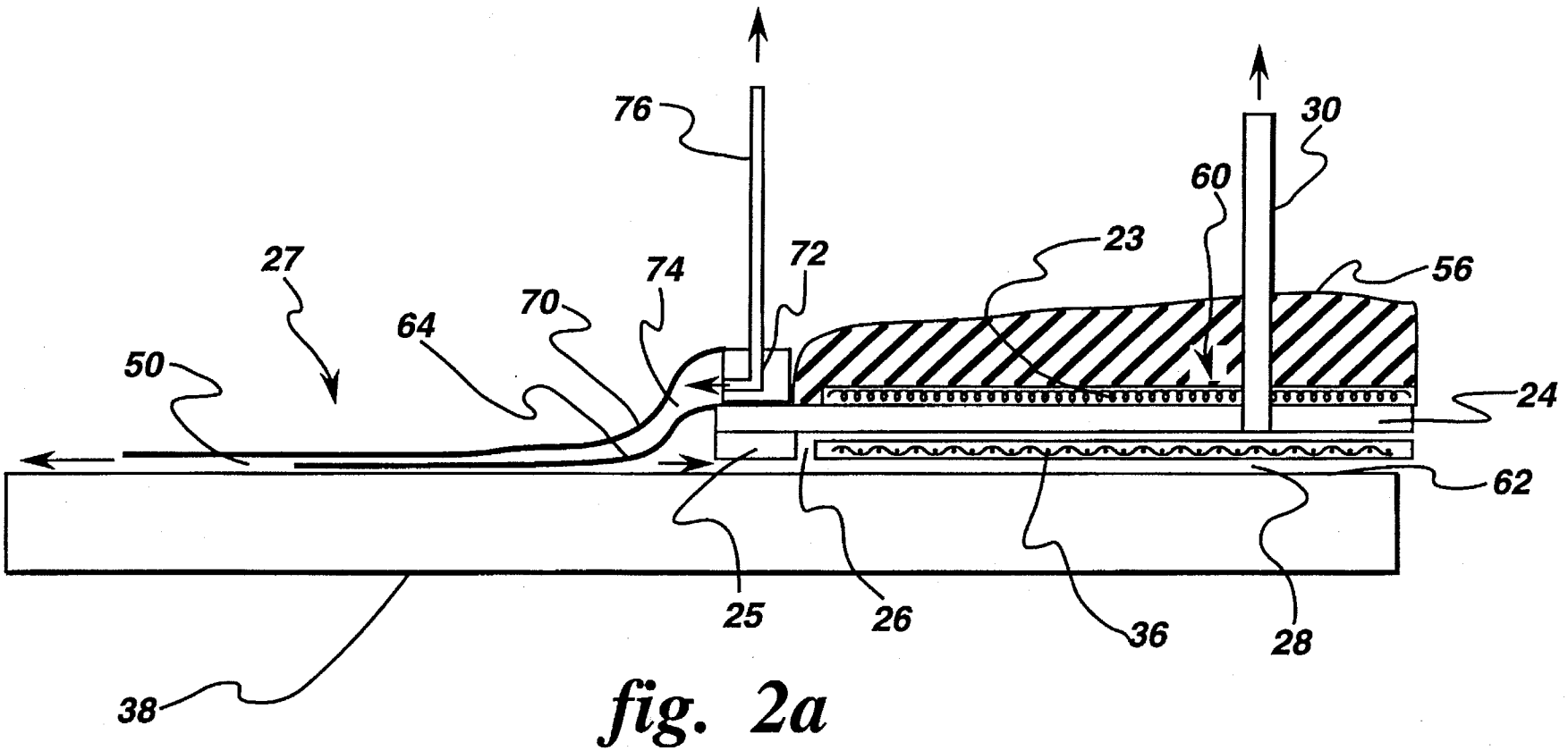
FIG. 2*a* is a schematic showing the details of the double layered vapor seal of FIG. 1.
Figure 2B:
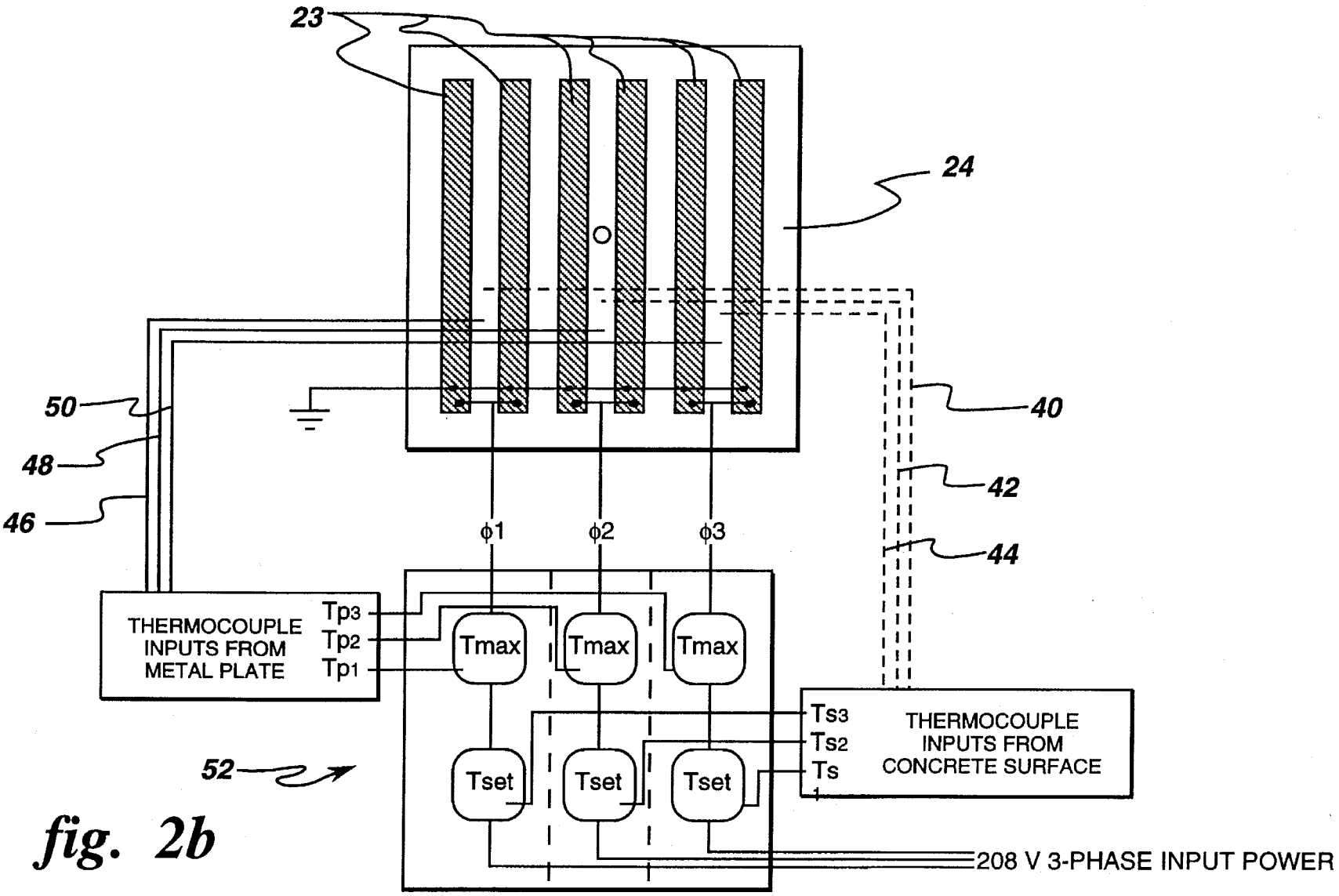
FIG. 2*b* is an enlarged, partial schematic of a representative controller used to regulate the heater and the concrete temperature.
Figure 3:
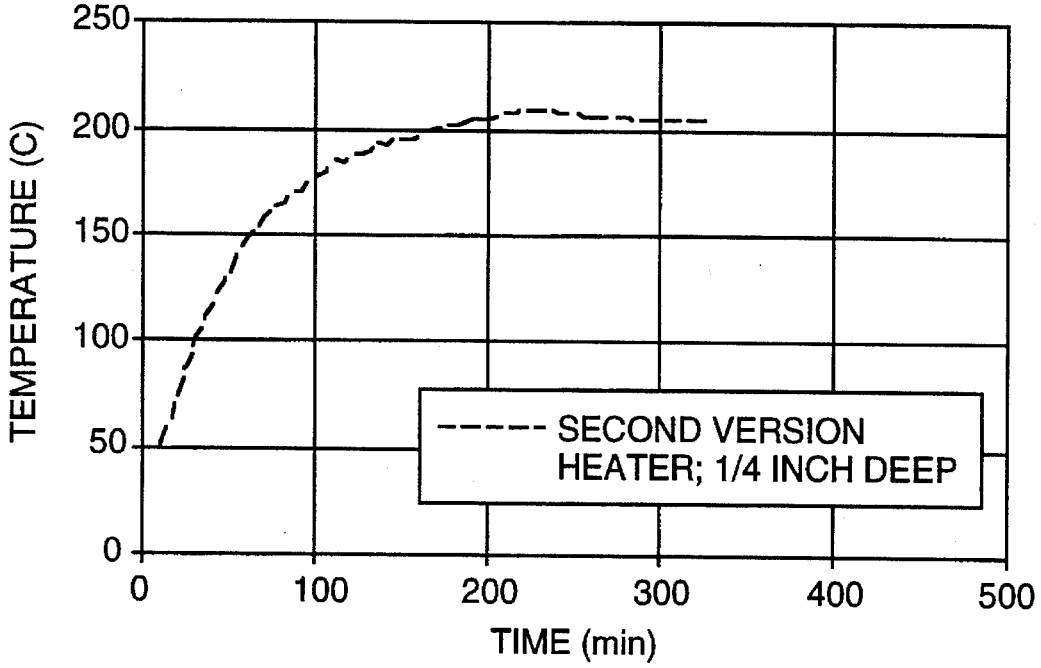
FIGS. 3 is a graph showing the heating rate at 0.25 inches depth with heaters attached to the top side of the copper plate laid proximate the concrete.

As shown in FIG. 2*b*, the six heaters 23 are divided into three pairs connected in parallel. Each pair is connected to one phase of a 208 V power supply. A controller 52 controls each phase independently to achieve a set point temperature measured by thermocouples 40, 42, 44 in contact with the concrete surface 38 immediately below the heaters 23. In addition, signals from thermocouples 46, 48, 50 attached to the heating plate 24 are input to the controller 52 to prevent overheating of the plate 24. The temperature of the plate 24 should be limited to a maximum of 350° C. to minimize thermal decomposition of PCBs. Thus, two temperature controllers are used for each phase, one to modulate the power to achieve a desired set point at the concrete surface, and a second to limit the maximum temperature that the desorbed vapors come in contact with, namely the temperature of the heater plate 24. The heating rates for a point 0.25" deep in concrete is shown in FIG. 3.

As best illustrated in FIG. 2*a*, a skirt 27, preferably made of silicone, about 12" wide is attached to the perimeter of the heating plate 24. This skirt 27 provides the vapor seal 50 that is formed around the periphery when vacuum is applied to the air plenum 26 by the pump 34 through piping 30. The skirt 27 covers all of the concrete 38 that is expected to be heated above 40° C. so that any region hot enough to significantly desorb PCBs will be covered and under vacuum thus preventing uncontrolled release of contaminant vapors.

One method for ensuring that the uncontrolled release of contaminant vapors is prevented and a non-oxidizing environment is maintained is illustrated in FIG. 2*a*. The skirt 27 is comprised of two members, a bottom member 64 and a top member 70, which are operatively connected to a housing member 72 positioned at the periphery of the system 20. The housing 72 has provisions for enabling a gas, such as an inert gas, from entering the gap 74 between the top and bottom seals. The inert gas is normally pumped in through piping 76. Since the air plenum 26 under the heating plate 24 is under a vacuum, the lower seal 64, when the system 20 is in operation, is normally pulled in close contact with concrete surface 62. During operation, the inert gas is pumped through piping 76 and between top seal 64 and bottom seal 70 so that a gas flow, as shown in FIG. 2*a*, is maintained therebetween. In this particular arrangement, the pressure inside the system and between the system and the concrete is less than the atmospheric pressure and the pressure between the bottom and top seals 64, 70 is maintained at a level greater than the atmospheric pressure thereby ensuring that the uncontrolled release of contaminant vapors is prevented.

In a typical operation the heating plate 24 will be heated to a temperature of about 300° C. The vacuum pump 34 will draw about 5 scfm of air under, for example, the representative four square foot heated plate 24. A comparatively small amount of water vapor and contaminant oil and PCB vapors will volatize from the concrete 38 as the temperature increases. These vapors are prevented from escaping into the ambient atmosphere by the vacuum flow. The heated vapor is drawn through the piping 30 to the vacuum pump 34. Before reaching the pump 34, the vapor temperature will drop from about 300° C. to about 20° C. in a condenser 52 to drop out oils and contaminants, and then the gases will go through an activated carbon canister 54 for polishing before being released to atmosphere at the vacuum pump 34 exhaust.

The system 20, as shown, typically requires a total of 6 kW of 3-phase 208 V power. Cooling water is required for the condenser 52 and liquid ring vacuum pump 34. A 2 hp vacuum pump that was used in the prototype system required 460 V 3-phase power.

Also shown in FIG. 1 is a sheet of high temperature thermal insulation 56 which covers the entire heating plate 24 and surrounds the pipes 30 to ensure adequate heating and protect personnel from contacting hot surfaces. In some applications, it may be necessary to ensure that the oxygen content in the purging gases are below a certain level to prevent oxidation or combustion of contaminants. The double seal, shown in FIG. 2*a*, can ensure that only inert vapors leak in at the periphery of the heating plate. By injecting an inert gas like nitrogen or carbon dioxide between the outer and inner seals so that the pressure between the two seals is above atmospheric pressure by about 0.02 to about 0.1 inches of water, one can guarantee that the vapors that do permeate under the inner seal into the heated region are inert gases.

As best shown in FIGS. 2*a* and 2*b*, the heating unit 60 may be constructed, for example, utilizing electrical resistance heaters 23 attached to the top of the metal plate 24. The system 20 is equipped with provision for electrical connections to supply electric power to the heating plate 24 which is placed proximate the concrete surface 62. Electrical power is supplied to the system 20 at power line frequencies of about 60 Hz. The vapors that emanate from the concrete when heated are collected by the suction pipe 30 that extends through the plate 24, as shown in FIG. 2*a*. Above the heating plate 24 is placed insulator 56 which must be a good thermal insulator. The skirt 18 can be attached to the perimeter of the system 20 to serve as a seal between the system 20 and the concrete 38 when suction is applied. Alternatively, an impermeable sheet 64 may cover the insulation and extend areally beyond the system to form a vacuum seal.

According to the teachings of this invention, a vacuum is applied through piping 30 connected to the system 20 creating a vacuum below the plate 24 will causes the flexible skirt 18 to be sucked tightly to the concrete surface 62 at the perimeter of the system 20. The concrete surface is sealed by the sheet 64 as atmospheric pressure pushes the impermeable sheet 64 against the concrete surface 62. At the center of the heating plate, the reduced pressure beneath the plate will suck the heating plate 24 toward the concrete surface. In the peripheral region beyond the heating plate, the flexible skirt will form a seal against the concrete. Thus, substantially only the air, concrete moisture, and contaminants in the concrete below the heating unit 60 will be pulled toward the concrete surface, minimizing the risk of spreading the surface contamination.

While applying a vacuum to the concrete, the temperature of the concrete is raised by applying heat to the surface of the concrete with the heating plate 24. The heating plate can reach temperatures as high as 450° C. or more, if necessary. A thermal front moves downward into the concrete by thermal conduction, thereby vaporizing water and contaminants in the near-surface concrete. For contaminants that are subject to thermal decomposition, at least a portion of the concrete may be heated to a temperature sufficient (500°–600° C.) to fragment contaminants into their decomposition products. It should be noted that the strength of most concrete will be significantly reduced upon heating to temperatures above 400° C.

Also, additional decomposition may occur as the vaporized contaminants pass through the very high temperatures at the heating plate. The vacuum is maintained throughout the heating period and for a sufficient time (2–5 hours) after heating to avoid contaminant losses or dispersion.

If a good seal is maintained, the reduced pressure at the concrete surface can be about 0.5 bar This will cause vaporization or boiling to occur at a lower temperature than the normal boiling point at atmospheric pressure. At the same time, the removal of high boiling point contaminants may be assisted by steam stripping as water vapor within the concrete vaporizes and convects contaminant vapors out of the concrete. Contaminants with normal boiling points above 300° C. can thus be removed by this method.

The water vapor and contaminants and/or decomposition products may be collected, for example, in a condensate trap 52 located between the opening in the plate 24 and the vacuum pump 34. Alternatively, the water and contaminant liquids can be separated on the basis of density in a separator, while the gases can be incinerated, or otherwise disposed. Alternatively, the contaminants and/or their decomposition products can be trapped and concentrated, for example, on molecular sieve material, on activated carbon 54, or in a wet scrubber. Thereafter, the concentrated contaminants and/or their decomposition products can be reused, or incinerated, or otherwise disposed. Alternatively, the contaminants and/or their decomposition products can be incinerated in line or thermally oxidized in line.

In one method, the system 20 is used to heat the concrete continuously at a constant or varying temperature. The heating unit can be tailored to use the minimum amount of electrical energy to heat the concrete to a predetermined minimum temperature (220°–350° C. for PCBs) at a minimum depth, required for volatilization and/or decomposition of the contaminants.

Some of the contaminants that can be removed by the system and apparatus of the present invention include hydrocarbons, pesticides, chlorinated hydrocarbons such as PCBs, chemical warfare products, radioactive wastes such as tritium and tritiated water, and heavy metal contaminants such as mercury, lead, etc. The present invention is, in general, applicable to any contaminant which has a vapor phase at elevated temperatures and reduced pressures, and/or may be decomposed at elevated temperatures and reduced pressures.

To demonstrate the apparatus on an actual concrete slab, a pilot scale system was constructed that heated a four $ft^2$ area. The system included vapor handling equipment which prevented release of PCB vapors in the room.

Example I

Oil and PCB desorption laboratory experiments
Experimental procedure

Experiments were conducted on concrete slab spiked with either 10 C oil or Aroclor 1254 mixed with 10 C oil. The concrete slabs measured 3 ft×3 ft by 2 in thick and were reported by the vendor to be at least several months old. A 1 ft by 1 ft section in the center of the slab was soaked with a mixture of heptane or hexane and oil or PCBs. The solvent was used to reduce the viscosity of the contaminant so that it could seep into the concrete. The solution was kept in place by a dam of silicone caulk which was removed after the solution was either absorbed into the concrete or evaporated. The solution was allowed to seep into the concrete for at least ten days; during this time the solvent evaporated. Concrete dust samples were taken before and after heating by drilling with a hammer drill using a ½" bit. By collecting the drilling dust generated at various depths contaminant profiles were generated. Drill samples were also taken in the unspiked region for comparison. Total organic carbon analysis was used as an indicator for 10 C oil and EPA method 8080 analysis was used for PCBs. Both analyses were conducted by an outside laboratory.

In the 10 C oil experiments about 250 g of oil was applied to the concrete. This resulted in an average increase of about 1.5% organic carbon in the top inch of concrete relative to the unspiked region. Two slabs were spiked with oil. In the first slab drill samples were taken at two depths (0–0.5 in and 0.5–1.0 in) and at three locations in the spiked area and in one location in the unspiked area. After drilling, the holes were filled with mortar. The first slab was heated 8 hr with an earlier version of the heating unit in which the heaters were embedded in granular silicon carbide which filled a 1½ inch thick air plenum formed by sheet metal. The concrete reached an average temperature of 142° C. in the top inch (150° C. at the surface and 134° C. at 1 in depth). Drill samples were taken at the two depths in the vicinity of the previous sample holes, and the holes were filled. The slab was heated for a second time six days after the first heating. The second heating also lasted 8 hr, but the concrete reached an average temperature of 164° C. (178° C. at the surface and 150° C. at 1 in depth). Again drill samples were taken at two depths in the vicinity of the original sample holes.

The second 10 C oil-spiked slab was also heated with the first version of the heating unit. In an attempt to improve heat transfer, copper pellets were used instead of granular silicon carbide. This enabled the concrete to be heated to an average temperature of 224° C. in the top inch (234° C. at the surface and 214° C. at 1 in depth) within 7 hr of heating. In this run drill samples before and after heating were taken at three depths (0–0.25 in, 0.25–0.5 in, and 0.5–1.0 in) at three locations in the spiked region and one location in the unspiked region.

The PCB-spiked slabs were prepared in the same manner as the 10 C oil slab. In this case 1 g of Aroclor 1254 and 2 g of 10 C oil were dissolved in 125 ml of hexane. The solution was applied to a 1 ft×1 ft region in the center of the slab. The mixture was allowed to seep into the slab and the hexane evaporate for a period of 20 days.

Both slabs were heated with a heating unit which could be utilized with the method of the present invention. The first slab was heated twice. The first heating lasted about 7 hr at which point the concrete surface reached 244° C. and 1 in deep reached 218° C. The slab was allowed to cool overnight and sampled. After sampling, the slab was reheated. This second heating lasted 8.5 hr and the surface reached 270° C. and 1 in deep reached 246° C. Drill samples were taken before and after each heating at two depths (0–0.25 in and 0.25–1 in) at two locations in the spiked area and one location in the unspiked region.

The second slab was heated for 8.5 hr and the surface reached 280° C. and 1 in deep reached 250° C. In addition to drill samples at two depths (0–0.25 in and 0.25–1 in) and two locations in the spiked area, hexane wipe samples were taken before and after heating.

Results and Discussion

10 C oil experiments

The application of the 10 C oil and heptane solution to the concrete resulted in elevation of the organic carbon content in both the 0–0.5 inch and 0.5–1 inch regions. The measured organic carbon content for the two slabs before and after heating is shown in Table I. In the heating of slab 1 it is clear that a greater percentage of oil was removed in the top half inch of concrete than in the second half inch. The fraction of carbon remaining in the concrete is plotted in FIG. 4. In this figure and in the following discussion, the amount of oil in the concrete is assumed to be proportional to the difference between the values measured in the spiked and unspiked areas. That is, an average background amount of organic carbon has been subtracted from the amounts measured in the spiked areas. Unfortunately this assay does not distinguish between actual oil and carbon resulting from oxidation or pyrolysis of the oil. However at the temperatures experienced in these experiments, we do not expect the oil to decompose.

About 57% of the oil, as determined by organic carbon analysis, remained in the top half inch after the first heating during which the surface reached 150° C. Only about 15% of the oil was removed from the second half inch, the bottom of which reached 134° C. After the second heating, to higher temperatures, about another 40% of the remaining oil was desorbed from the top half inch while there was a slight increase, negligible in terms of the expected error, in the carbon content in the second half inch. Because the surface temperature reached 178° C. as opposed to 150° C. in the first heating, it is difficult to determine whether the additional removal was attributable to the increase in residence time or temperature.

Figure 4:
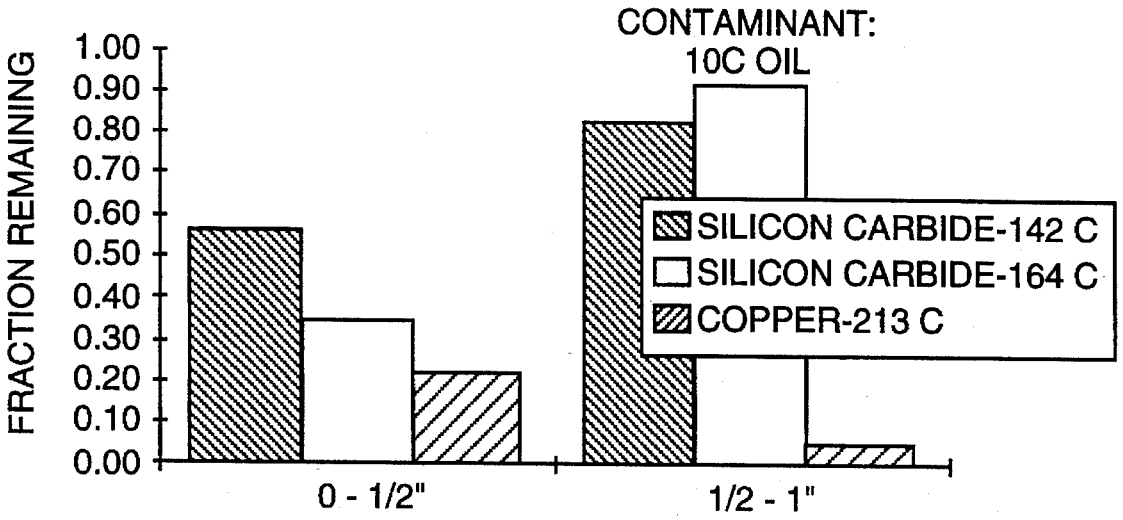
FIG. 4 showing the effect of concrete temperature on 10 C oil desorption.
Figure 5:
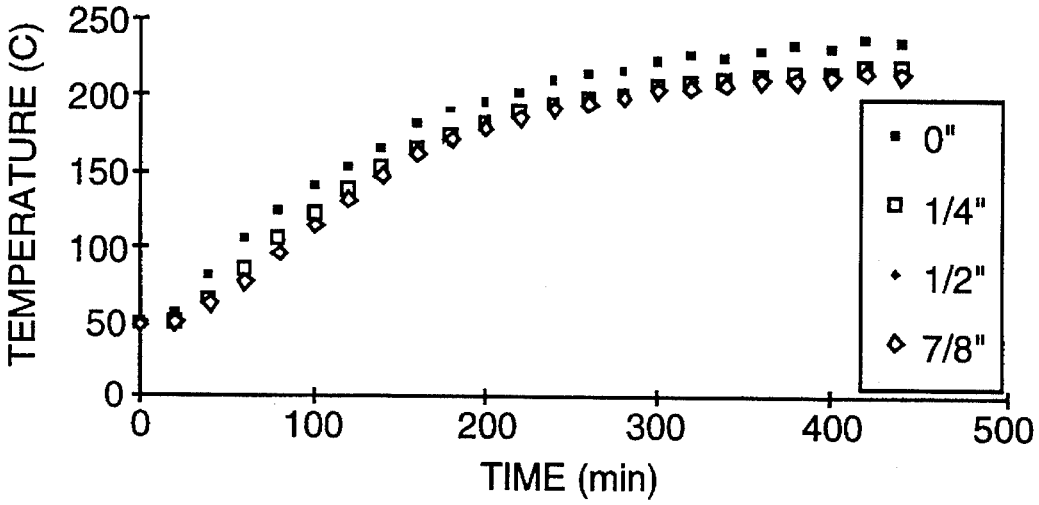
FIG. 5 illustrates the temperature history during thermal desorption of 10 C oil from concrete.
Figure 6:
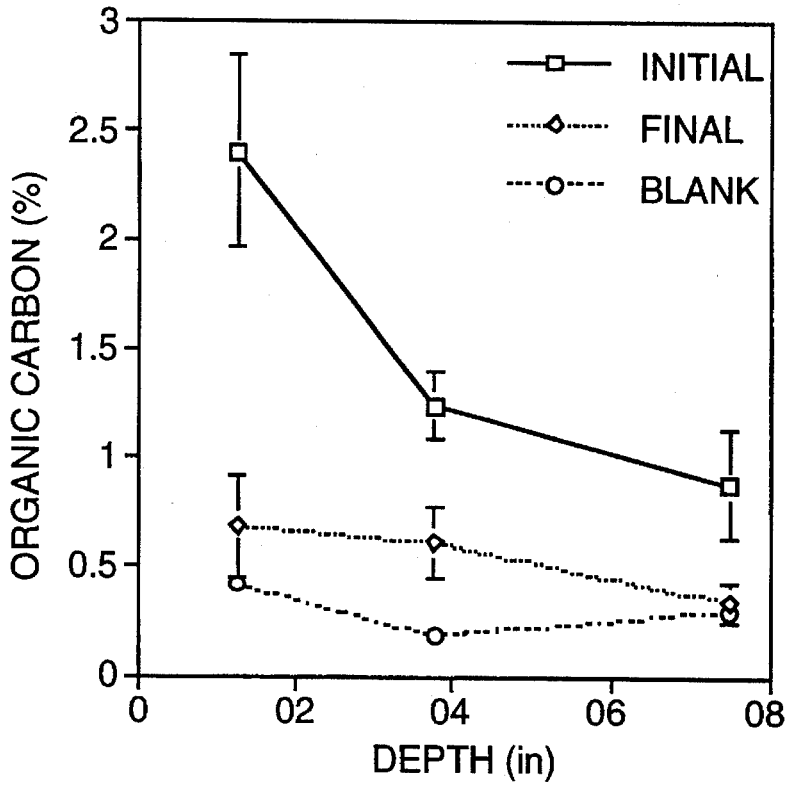
FIG. 6 illustrates the distribution of organic carbon before and after heating to 234° C. at the surface at 214° C. at one inch depth and the distribution in the unspiked area.

The second test in which copper pellets filled the heating unit clearly showed the effect of temperature on increasing the rate of 10 C oil desorption. In this case after 7 hr the surface reached 234° C. and 1 in deep reached 214° C. The improved desorption at the higher temperature is shown in FIG. 4. The temperature responses at various depths are shown in FIG. 5. In this test the concrete was sampled at three depths with the average organic carbon concentration shown in Table I An average of 80% of the oil was removed from the top half inch and over 90% was removed from the second half inch. The higher than expected removal efficiency from the second half inch may be attributable to the low initial oil concentration and experimental error. A plot indicating the standard deviation of the measurements of the organic carbon distribution before, after and in the unspiked area is shown in FIG. 6.

These experiments demonstrate the feasibility of using heat to desorb semi-volatile organics from concrete. It is clear that the amount that can be removed is a strong function of temperature and since PCBs have vapor pressures similar to 10 C oil it will be necessary to heat the concrete well above 200° C. to achieve significant decontamination.

TABLE I

Organic carbon content in drill samples from 10 C. oil spiked slabs.
Organic Carbon Content (% by wt.)

| Sample | Initial | After Heating to 142° C. | After Heating to 164° C. |
|---|---|---|---|
| Slab 1-Spiked area | | | |
| 0–1/2" | 2.31 | 1.41 | 1.11 |
| 1/2–1" | 2.00 | 1.70 | 1.87 |
| Slab 1-Unspiked area | | | |
| 0–1/2" | 0.29 | 0.20 | 0.45 |
| 1/2–1" | 0.33 | 0.16 | 0.10 |

| Sample | Initial | After heating to 213° C. |
|---|---|---|
| Slab 2-Spiked area | | |
| 0–1/4" | 2.40 | 0.68 |
| 1/4–1/2" | 1.24 | 0.61 |
| 1/2–1" | 0.88 | 0.34 |
| Slab 2-Unspiked area | | |
| 0–1/4" | 0.42 | — |
| 1/4–1/2" | 0.18 | — |
| 1/2–1" | 0.30 | — |

Notes:
Values represent averages of three samples in spiked area and two samples in unspiked area

PCB/10 C Oil Experiments

Figure 7:
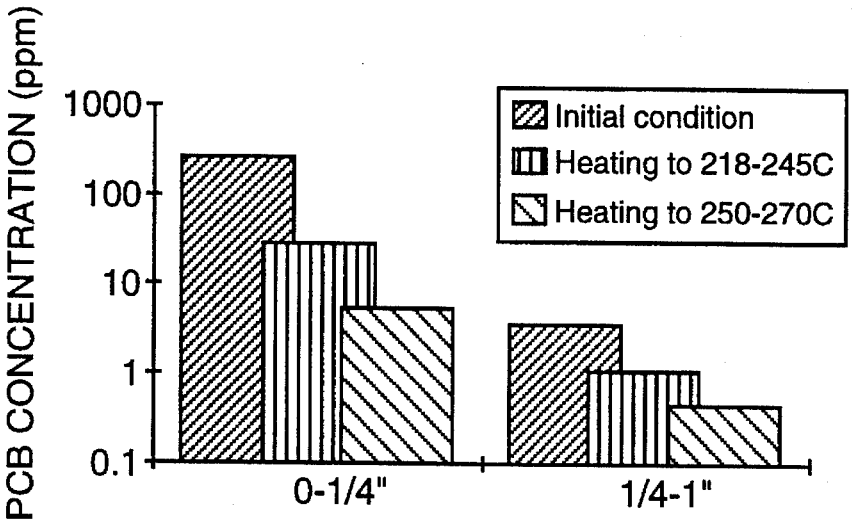
FIG. 7 is a graph illustrating the effect of heating on desorption of A1254 from a spiked concrete sample.

The spiking procedure resulted in significant contamination of only the top ¼ inch of concrete with average concentrations of about 300 ppm. In the next ¾ of an inch PCBs were measurable but only at concentrations less than about 10 ppm. The average values for the PCB concentration in the drill samples are shown in Table II. The two zones indicate to areas from where the sample were taken. Looking down on the slab, zone I was the lower left quadrant and zone II was the upper right quadrant of the 1 ft×1 ft spiked area. After the first heating stage both zones showed significant decontamination. 82% and 96% of the initial PCBs was removed from the top ¼ inch and 80% and 62% was removed in the next ¾ inch in zones 1 and 2 respectively. Interestingly, zone II had more complete decontamination in the top section compare to zone I, while zone I was more decontaminated in the deeper section. After the second heating stage, the PCBs were almost fully removed from both zones. An average of 98.1% of the PCBs were removed from the top ¼ inch and the deeper samples had 1 ppm or less PCBs remaining. The averages of the result for zones 1 and 2 are plotted in FIG. 7.

TABLE II

| | PCB Concentrations in samples from first thermal desorption experiment PCB Conc. (ppm) | | | |
|---|---|---|---|---|
| Sample | Initial | After Stage 1 218–244° C. | After Stage 2 246–270° C. | Percent removal after Stage 2 (%) |
| Zone I | | | | |
| 0–1/4" | 280.0 | 49.4 | 3.0 | 98.9 |
| 1/4–1" | 2.5 | 0.5 | <0.5 | >80 |
| Zone II | | | | |
| 0–1/4" | 278.0 | 9.8 | 7.8 | 97.2 |
| 1/4–1" | 5.0 | 1.9 | 1.0 | 80.0 |
| Averages: | | | | |
| 0–1/4" | 279.0 | 29.6 | 5.4 | 98.1 |
| 1/4–1" | 3.8 | 1.2 | 0.5 | >80 |

Figure 8:
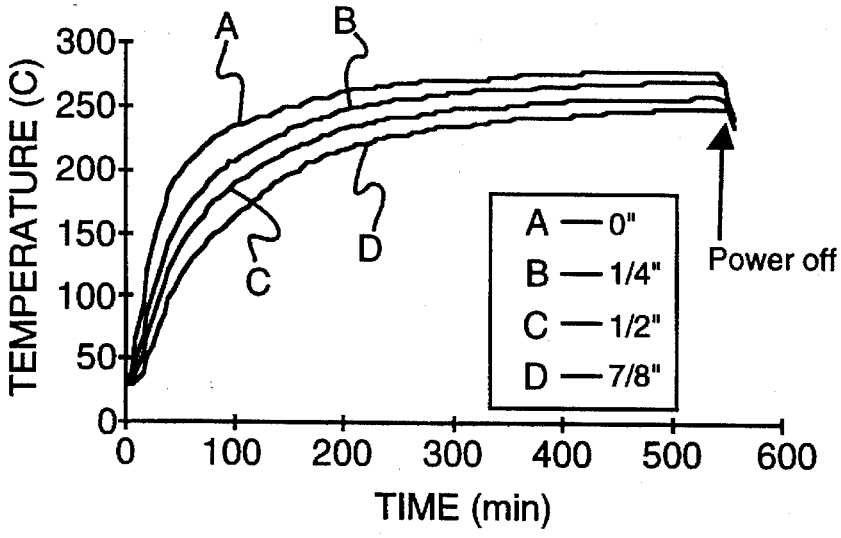
FIG. 8 is a graph illustrating the temperature responses at several depths in second PCB desorption experiment.
Figure 9:
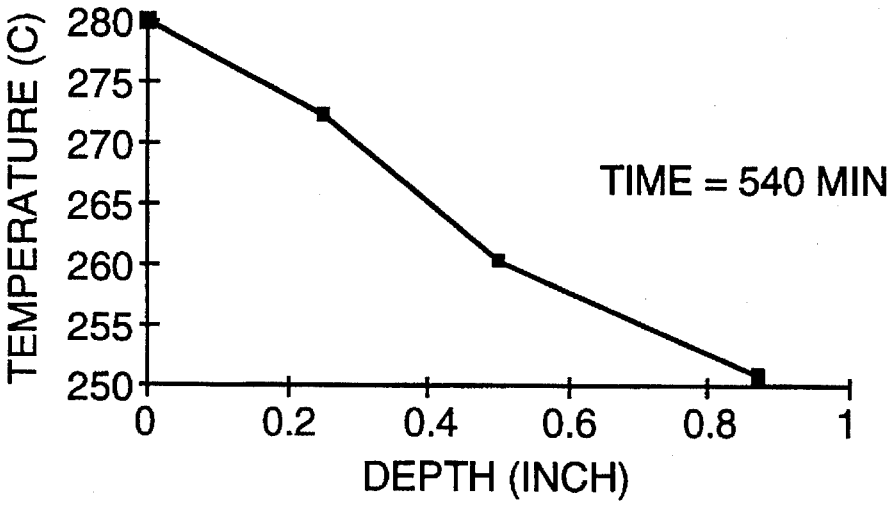
FIG. 9 is a graph showing the temperature profile in the second PCB desorption experiment after 540 minutes of heating.

It was concluded from the previous experiments that an 8 hr heating which reached a temperature of at least 246° C. would be required to remove the PCB from the top 1 inch of concrete. The purpose of the experiment on the second PCB-spiked slab was to decontaminate the slab in one heating cycle. In the second test the initial PCB concentration was about 300 ppm in the top ¼" and 7 ppm in the next ¾". Surface contamination as measured by surface wipe was 750 μg/100 $cm^2$. The temperature responses at various depths are shown in FIG. 8 and the temperature profile at the end of the experiment is shown in FIG. 9. After heating the top of the concrete to 280° C. and one inch deep to 250° C. and maintaining these temperatures for about three hours, all of the post-heating concrete drill dust samples and the surface wipe had PCB concentrations below the analytical detection limit of 1 ppm for the dust and 2 μg/100 $cm^2$ for the wipes. The data are presented in Table III.

TABLE III

| | PCB Concentrations in samples from second thermal desorption experiment PCB Conc. (ppm) | | |
|---|---|---|---|
| Sample | Initial | After heating to 251–279° C. | Percent removal after heating (%) |
| Zone I | | | |
| 0–1/4" | 250.0 | <1 | >99.6 |
| 1/4–1" | 4.1 | <1 | >75.6 |
| Zone II | | | |
| 0–1/4" | 360.0 | <1 | >99.7 |
| 1/4–1" | 9.4 | <1 | >89.4 |
| Averages: | | | |
| 0–1/4" | 305.0 | <1 | >99.7 |
| 1/4–1" | 6.8 | <1 | >85.3 |
| Wipes (μg/100 $cm^2$) | 750 | <2 | >99.7 |

While the total amount of energy that was used to heat the concrete was not actually measured, frequent observations of the controllers indicated that the power was output at about 25% of full capacity for most of the run. The power load was higher early in the run and lower at the end. The average energy flux from the heaters was about 0.25×6 kW/0.4 $m^2$ or 3.8 kW/$m^2$. The heat being conducted through the slab at the end of the experiment can be estimated from the temperature profile shown in FIG. 13 and is about 2.6 kW/$m^2$ assuming a thermal conductivity of 2 W/m/°C. At the end of the experiment very little energy was going into raising the concrete temperature, so it can be assumed that the remaining 1.2 kW/$m^2$ went into heating the vapor stream and losses through the insulation. If we assume the 4 kW/$m^2$ are required for an 8 hr period, then the amount of energy required would be 32 kWh/$m^2$. At $0.10/kWh this translates to $3.2/$m^2$ which is small compared to current methods which cost $30–250/$m^2$.

Cracking

It should be noted that in all experiments using the demonstration unit to heat a 3 ft×3 ft×2 inch slab of concrete, one or two small cracks were observed to migrate from the edge of the slab toward to center. These cracks are probably caused by tensile stresses on the perimeter of the slab that result from the thermal expansion of the heated central portion of the slab. The significance of these cracks in actual remediation cases will depend on the intended use of the concrete. The bulk concrete strength as determined for core compression tests is not likely to be reduced more than 20% in heating to 300° C. However macroscopic cracks may effect the overall strength of concrete structures. Aged concrete floors in industrial buildings usually have numerous cracks in them already and they still function adequately. Therefore analysis of the load bearing requirements of the concrete structure should be performed before applying thermal desorption for remediation purposes.

Summary

Tests utilizing methods of the present invention for PCB decontamination of concrete were completed on 2 inch thick slabs which were spiked with a mixture of Aroclor 1254 and 10 C transformer oil. The first test showed that heating the concrete to an average temperature of 230° C. removed 90% of the PCBs from the top ¼" leaving about 30 ppm PCB in the concrete. The PCBs levels in the next ¾" were reduced 70% to about 1 ppm. In the second test the concrete was heated to an average temperature of 260° C. and held at that temperature for 3 hours. The initial PCB concentration was about 300 ppm in the top ¼" and 7 ppm in the next ¾". The initial surface contamination as measured by surface wipe was 750 μg/100 $cm^2$. After heating all of the concrete core samples and the surface wipe had PCB concentrations below the analytical detection limit of 1 ppm (or 2 μg/100 $cm^{2)}$ . These experiments demonstrated the ability of thermal desorption to clean PCBs from concrete to at least 1" depth while generating a minimum amount of secondary waste in the form of condensed oils and used activated carbon.

The experiments presented above demonstrate the ability to thermally desorb PCBs and 10 C oil from concrete surfaces and subsurfaces to depths of at least one inch. Bench-scale experiments on a one inch thick aged concrete slab contaminated with Aroclor 1248 and 1260 demonstrated complete decontamination (less than 0.6 ppm remaining) after heating the top 310° C. and the bottom to 220° C. for two hours. Using a pilot scale demonstration unit, Aroclor 1254 was removed (less than 1 ppm remaining) from a spiked concrete slab at a temperature of about 250° C. The required power density is about 4 kW/$m^2$ and the associated energy costs for this process will depend strongly on the depth required to clean, but for one inch should be about \$3.2/$m^2$. Cracks were observed to propagate in the concrete slabs, but the slabs remained intact. In field applications of this process, structural analysis of the concrete will be required to determined whether such cracking is detrimental to the function of the concrete.

Thermal desorption of PCBs from concrete appears to have many advantages over current technologies. First, the amount of waste generated is minimal whether the PCB vapors are condensed or destroyed in a thermal oxidizer. Second, the process has the ability to remove PCBs from the subsurface and thereby prevent any future migration of contaminants back to the surface. In cases where the building is being demolished, this technique may allow the concrete debris to be disposed of as non hazardous material.

Standard Operating Procedure for Concrete Decontamination

Standard operating procedures are actions taken by the operators to maintain optimum process conditions, ensure data quality objectives are met, and ensure the system operates safely. The presently recommended standard operating procedures for the apparatus of the present invention include: controlling the maximum temperature of heated plated to prevent destruction of PCBs; controlling the temperature of the concrete surface to ensure adequate heating and prevent overheating; monitoring the concrete temperature at 1" and 2" depths to ensure desorption temperatures are reached in contaminated regions; monitoring the vacuum pressure to make sure a negative pressure exists over heated areas ensuring control of vapor emissions; monitoring ambient air for combustible vapors; and monitoring the condenser temperature to ensure optimum temperature of the carbon bed are achieved.

Apparatus Shut-down Procedure

The presently recommended procedure to follow when shutting down the apparatus of the present invention is as follows: de-energize the heaters while continuing to monitor concrete surface temperature. When surface temperature is less than 40° C., disengage the vacuum pump; when the heater has cooled sufficiently, the system can be taken down and moved.

Example II

The illustrative apparatus of the present invention was tested on a aged concrete transformer pad contaminated with Aroclor 1260. After the first heating in which the surface of the concrete was heated to 275° C. and 1.5" depth reached 220° C. after ten hours of heating, the PCB concentration was reduced from 8300 ppm to 343 ppm in the top 0.38" and from 290 ppm to 8 ppm at about 1" depth. The concrete was reheated to determine if additional heating could remove the remaining PCBs. Because of the higher heater temperature used in second heating (350° C. vs 325° C. in the first run) the concrete heated faster and 1.5" depth was held at 225° C. for over 5 hours.

PCB analysis revealed that the contaminant concentration was unchanged after the second heating. This implied that the remaining PCBs would not be removed at these temperatures and that changes in the process, such as increasing the heater temperature to about 450° C. would be required in order to further lower the PCB levels.

Figure 10:
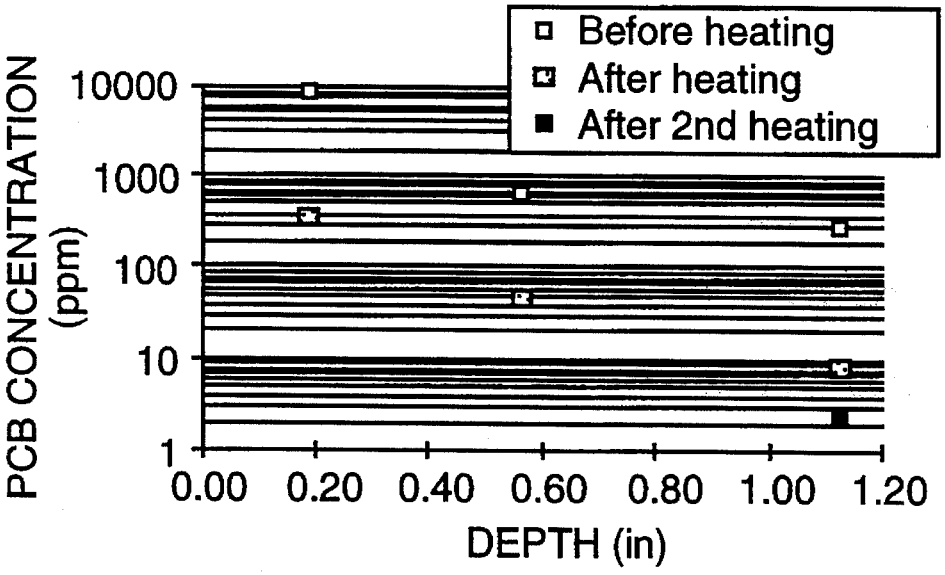
FIG. 10 is a graph illustrating the Aroclor 1260 distribution before and after heating concrete.

The PCB concentration profiles in the concrete before and after the two heating cycles are shown in FIG. 10. These data represent averages of three separate points. Notice that while the first heating reduced the concentration from 8300 to 340 ppm in the top section, the second heating had no effect. The second heating did reduce the average concentration in the 0.75"–1.5" zone from 8 to 2.5 ppm, but this effect is small and probably within the expected error range of the measurements. The surface wipe assay which is usually used to determine the contamination of concrete surfaces showed 780 μg/100 $cm^2$ before heating and 2.4 μg/100 $cm^2$ after the first heating. Since the regulatory limit is 10 μg/100 $cm^2$ the first heating appeared sufficient to clean the concrete. However, surface wipes taken after the second heating showed an average of 26 μg/100 $cm^2$, which is considerably higher than the regulatory limit. We believe that this result reflects the inherent inaccuracy of wipe tests on porous surfaces more than an actual increase of PCBs.

Figure 11:
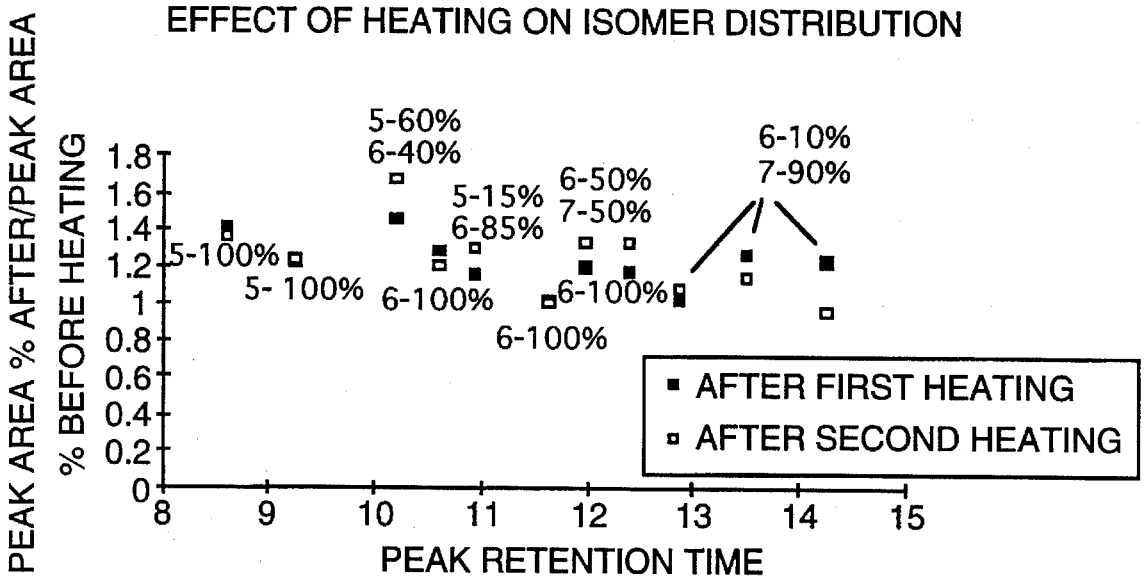
FIG. 11 is a graph showing the effect of heating of chromatograph peak distribution.

Analysis of the chromatograms (EPA method 8080) before and after heating revealed that all of the major homologue groups of Aroclor 1260 responded similarly to the heating and there was no evidence of preferential removal of the lower chlorinated congeners. A graph of this effect is shown in FIG. 11 where the relative weight of each peak is divide by the relative weight of that peak before heating. If there were preferential removal of the lower chlorinated congeners then one would expect the ratio to increase with retention time.

General Conclusions

Compared to concrete surface removal techniques which typical remove 2 to 10 mm of the top layer of concrete, the thermal desorption method of the present invention can decontaminate to a depth of several centimeters. For example, the time required to heat a typical concrete slab by conduction to a depth of 5 cm has been found to be about 90 minutes. Because the heating of the concrete can be conducted quite evenly, the decontamination should be more uniform than could be achieved by chemical washing methods. Because of the complex structure of concrete the chemical washing solution may not have access to a considerable portion of the concrete matrix.

One of the major costs associated with the technologies available for concrete decontamination is the disposal cost of the removed contaminated material. In the surface removal techniques large volumes of rubble and dust must be treated or disposed of in regulated landfills. In the chemical cleaning processes large amounts of secondary cleaning solutions must be disposed. The present invention concentrates the removed contaminants in the forms of a condensate and an adsorbate on a material such as activated carbon. The resulting material volume requiring disposal is greatly reduced and the concrete remains intact for potential reuse.

The present invention does not involve the use of any washing liquids to remove contaminants. As a result, there are no secondary liquids which would require treatment as hazardous waste.

Under the anticipated maximum thermal requirement of about 4 $kW/m^2$ and exposure time of about 8 hours, the electrical energy costs for the heating process should be less than $\$3.2/m^2$.

There are no surfactants, solvents, or other potentially hazardous chemicals required in the desorption process of the present invention. Only thermal energy is applied and contaminated vapors drawn out of the concrete by the vacuum pressure.

Unlike surface removal techniques, there is no grinding or scabbling of the concrete in the proposed process. Therefore there is no production of airborne particulate matter which could be hazardous to workers in the area of the decontamination project.

Different contaminants will have different vapor pressure/temperature relationships. This means that the process of the present invention can be customized for the specific contaminants at hand. More volatile contaminants will require less heating and vacuum pressure and can therefore employ less expensive pumps, heaters and power supplies than the less volatile species.

While the methods herein described constitute preferred embodiments of the invention, it is to be understood that the invention is not limited to these precise methods and that changes may be made therein without departing from the scope of the invention which is defined in the appended claims.

What is claimed is:

1. A method for decontamination of concrete having a surface and having contamination therein comprising the steps of:

placing an impermeable heating means proximate the concrete surface;

placing a thermal insulator means above the heating means;

placing an impermeable means that extends areally beyond the heating means such that a seal is formed between the heating means and the concrete surface;

applying a vacuum to the concrete through an opening in the impermeable heating means;

heating the concrete with the heating means to a temperature above 100° C.; and vaporizing the contamination in the concrete.

2. The method of claim 1 further comprising the step of:

recovering the vaporized contamination through a vacuum collection system.

3. The method of claim 1 wherein the vaporization of contamination having normal boiling points occurs at a temperature below the normal boiling points of the contaminants.

4. The method of claim 1 wherein the concrete is heated to a temperature of about 200° C. to about 450° C. to decompose the contamination into decomposition products, and wherein the decomposition products, and any contamination not decomposed but vaporized, are recovered through the vacuum collection system.

5. The method of claim 1, wherein the heating means operating temperature is sufficient to heat the concrete surface to about 250° C. to about 450° C.

6. The method of claim 1, wherein the heating means operating temperature is sufficient to heat the concrete surface to about 300° C. to about 450° C.

7. The method of claim 1, wherein the heating means operating temperature is sufficient to heat the concrete surface to about 400° C.

8. The method of claim 1, wherein the decomposition products, and any contamination not decomposed but vaporized, are recovered through the vacuum collection system.

9. A method for remediation and decontamination of concrete having a surface and contamination comprising the steps of:

placing an impermeable electric heater proximate the concrete surface;

placing a thermal insulation layer above the impermeable heater;

placing an impermeable sheet above the thermal insulating layer that extends areally beyond the heater such that a seal is formed between the heating means and the concrete surface;

applying a vacuum to the concrete surface through an opening in the impermeable electric heater;

heating the concrete with the electric heater by heating the concrete to a temperature above 100° C.; and vaporizing the contamination in the concrete.

10. The method of claim 9 further comprising the step of:

recovering the vaporized contamination through a vacuum collection system.

11. The method of claim 9 wherein the vaporization of contamination having boiling points occurs at a temperature below the boiling points of the contamination.

12. The method of claim 9, wherein the concrete is heated to a temperature above about 200° C. sufficient to decompose the contamination into decomposition products, and wherein the decomposition products, and any contamination not decomposed but vaporized, are recovered through the vacuum collection system.

13. The method of claim 9, wherein the surface heater is operated at a temperature sufficient to heat the concrete to a temperature above 200° C. to decompose the contamination into decomposition products.

14. The method of claim 13, wherein the surface heater operating temperature is sufficient to heat the concrete surface to a temperature of about 200° C. to about 450° C.

15. The method of claim 13, wherein the surface heater operating temperature is sufficient to heat the concrete surface to a temperature of about 250° C. to about 450° C.

16. The method of claim 13, wherein the surface heater operating temperature is sufficient to heat the concrete surface to a temperature of about 400° C.

17. A method for remediation and decontamination of concrete having a surface and contaminants comprising the steps of:

placing an impermeable heater proximate the concrete surface;

placing a thermal insulation layer above the heater;

placing a flexible skirt around the periphery of the impermeable heater to serve as a vapor seal;

applying a vacuum to the concrete through an opening in the impermeable heater;

heating the concrete by thermal conduction with the heater to a temperature of about 200° C. sufficient to decompose at least some of the contamination into decomposition products;

vaporizing contamination in the concrete that are not decomposed by heating; and recovering the decomposition products, and any contamination not decomposed but vaporized, from the concrete through a vacuum collection system.

18. The method of claim 17, wherein the flexible skirt maintains gas flow such that oxidizing gas is prevented from reaching the heater.

* * * * *